United States Patent [19]

Axinger et al.

[11] Patent Number: 4,829,903

[45] Date of Patent: May 16, 1989

[54] AMMUNITION DEVICE

[75] Inventors: Jan Axinger, Storfors; Bernt-Olov Bergman; Ingemar Johansson, both of Karlskoga; Tomas Lönnermo, Vintrosa; Lars Paulsson, Kristinehamn; Per-Olof Persson, Karlskoga, all of Sweden

[73] Assignee: Aktiebolaget Bofors, Bofors, Sweden

[21] Appl. No.: 127,149

[22] Filed: Dec. 1, 1987

[30] Foreign Application Priority Data

Dec. 1, 1986 [SE] Sweden ..... 8605123

[51] Int. Cl.[4] ..... F42B 13/32; F42B 13/50; F42B 25/16; F42B 25/24

[52] U.S. Cl. ..... 102/384; 102/388; 244/3.27; 244/3.29

[58] Field of Search ..... 102/384, 388; 244/3.1, 244/3.24, 3.27, 3.28, 3.29

[56] References Cited

U.S. PATENT DOCUMENTS

| | | | |
|---|---|---|---|
| 1,300,708 | 4/1919 | Edison | 244/3.27 |
| 2,918,235 | 12/1959 | Aberg et al. | 102/384 |
| 3,115,831 | 12/1963 | Suter | 102/388 |
| 3,602,459 | 8/1971 | Pesarini et al. | 244/3.27 |
| 3,604,352 | 9/1971 | Bench | 244/3.27 |
| 3,702,588 | 11/1972 | Simmons | 244/3.29 |
| 3,719,339 | 3/1973 | Simmons et al. | 244/3.27 |
| 3,768,755 | 10/1973 | Prochnow et al. | 244/3.24 |
| 4,158,497 | 6/1979 | Humphries et al. | 244/3.27 |
| 4,264,045 | 4/1981 | Campbell | 244/164 |
| 4,350,315 | 9/1982 | Pollin | 244/3.1 |
| 4,356,770 | 11/1982 | Atanasoff et al. | 102/384 |
| 4,583,703 | 4/1986 | Kline | 244/3.24 |
| 4,635,553 | 1/1987 | Kane | 102/384 |
| 4,674,705 | 6/1987 | Schleicher | 244/3.1 |

FOREIGN PATENT DOCUMENTS

| | | |
|---|---|---|
| 0182018 | 5/1986 | European Pat. Off. . |
| 3400083 | 8/1984 | Fed. Rep. of Germany . |
| 3323685 | 1/1985 | Fed. Rep. of Germany . |
| 3422231 | 12/1985 | Fed. Rep. of Germany . |
| 3333517 | 9/1986 | Fed. Rep. of Germany . |
| 8007834-8 | 11/1979 | Sweden . |
| 8601423 | 3/1986 | Sweden . |

*Primary Examiner*—David H. Brown
*Attorney, Agent, or Firm*—Pollock, Vande Sande & Priddy

[57] ABSTRACT

A device for reducing the rotational speed of an ammunition unit, for instance a submunition unit, and at the same time imparting to the ammunition unit a lateral speed includes a body arranged to be swung out from the ammunition unit and be released in a specific outswung position. The body preferably consists of a band which is wrapped about the outer peripheral surface of the ammunition unit. One end of the band is fixed to the ammunition unit in such a way that the band is released in a specific outswung position.

5 Claims, 5 Drawing Sheets

FIG. 4
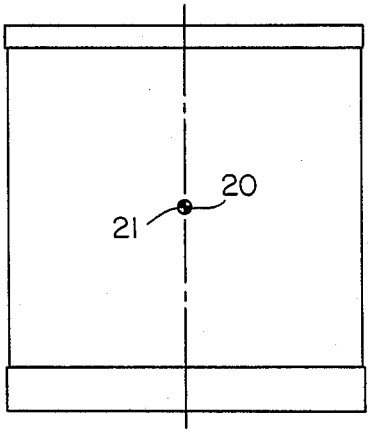
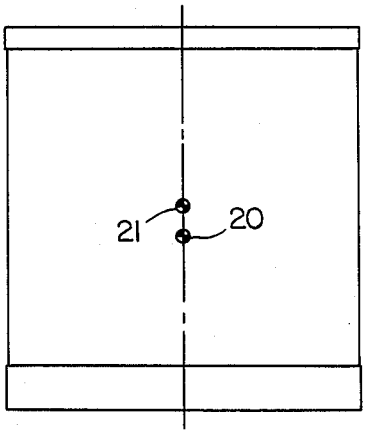
FIG. 4a

AMMUNITION DEVICE

BACKGROUND OF THE INVENTION

The present invention relates to a device for reducing the rotational speed of an ammunition unit and at the same time imparting a lateral speed to the ammunition unit.

Even if the invention can be used for all types of ammunition units for which a reduced rotational speed is desired, such as pyrotechnical ammunition, shaped-charge ammunition or the like, in the following the invention will be described in connection with submunitions, for example submunition units which are released from an aeronautical body, for instance a shell canister or the like, over a target area for searching this area in a helical pattern during the fall of the submunition towards the target area. Such submunitions are previously described in U.S. patent application Ser. No. 028,949.

In order to efficiently search a large target area it is necessary to limit the speed of fall towards the ground. Also a controlled rotational speed is necessary. The rotational speed must be high enough to make sure that the maximal interscan distance during the searching phase is less than the width of the target.

In case the submunition unit has no original rotational speed it is necessary to impart such a speed to the unit. In U.S. Pat. No. 4,356,770 a submunition unit is disclosed which has no original rotational speed but which is imparted such a speed by means of a breakable driving band which is fastened to the launching tube by one of its ends and partially surrounds the submunition unit.

On the other hand the rotational speed should not be too high for a desired wobbling, precession or helical motion to be maintained. For use in a modern artillery shell, for which the rotational speed amounts to more than 10,000 rpm, the rotational speed of the submunition device has to be reduced after separation from the shell body.

Prior art brake rotation devices for achieving a sensing motion are often of the parachute type, but devices using mechanical vanes are also previously known. In U.S. patent application Ser. No. 028,949 the submunition unit has a specific aerodynamical design so that a controlled rotational speed is obtained and the fall speed is limited.

In order to avoid interference between the searching areas of each submunition unit, and also to prevent a detonating submunition unit from disturbing other submunition units, the submunition units should have a specific distribution in the lateral direction. In some cases the lateral spread imparted to the submunition units due to the translational speed of the shell at the separation is enough. In other cases it is necessary to impart to the submunition unit a specific lateral movement. When the submunition units are released above the central part of a target area lateral movements in different directions should be imparted to the submunition units in order to cover as large a target area as possible.

For submunition units of the parachute type it is previously known to control the lateral speed to some extent by controlling the parachute. From DE-PS 33 23 685 it is previously known to control the lateral speed in order to increase the effect on a target area. By means of a motor the guide ropes of the parachute are actuated so that the submunition unit during its free trajectory moves in a desired direction. This is a complex system, however, and a comparatively large space in the shell canister is required which reduces the number of submunition units contained in the shell canister.

SUMMARY OF THE INVENTION

The object of the present invention is to provide a device by means of which the lateral speed is obtained in a simple way and which device requires a minimum of space. According to the present invention a body is attached to the ammunition unit and arranged to swing outwardly and be released in a specific outswung position, preferably when forms outswung position of 70°-90° with respect to the ammunition unit.

In a preferred embodiment the body consists of a band which is wrapped around the outer peripheral surface of the ammunition unit.

In the following a preferred embodiment of the invention present will be described more in detail in connection with the accompanying drawings.

BRIEF DESCRIPTION OF THE DRAWINGS

FIGS. 4 and 4*a* illustrates an ammunition unit and a band having coinciding and non-coinciding centers of gravity.

DETAILED DESCRIPTION OF THE PREFERRED EMBODIMENT(S)

Figure 1:
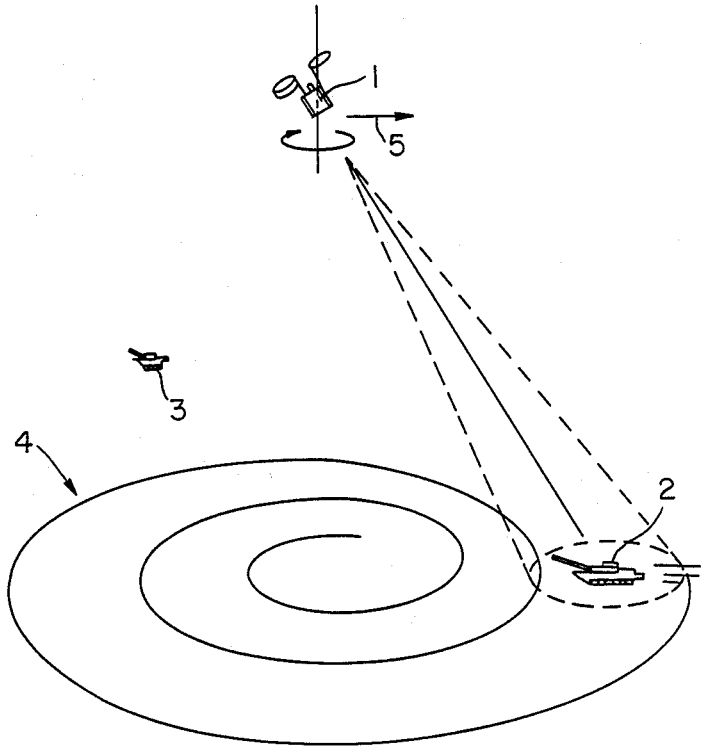
FIG. 1 illustrates schematically the scanning movement of a submunition unit.

FIG. 1 illustrates a submunition unit 1 which has been separated from a canister in a carrier shell. The carrier shell, the canister and the separation procedure are not described here in any detail as they do not form part of the present invention. For instance the shell may be of 15.5 cm calibre discharged from a field artillery piece in a conventional way in a ballistic trajectory towards a target area with discrete targets in the form of armoured vehicles 2 and 3. The submunition unit may be of the type described in U.S. application Ser. No. 028,949 and which scans the target area in a helical pattern 4. The arrow 5 indicates the desired lateral movement of the submunition unit.

Figure 2:
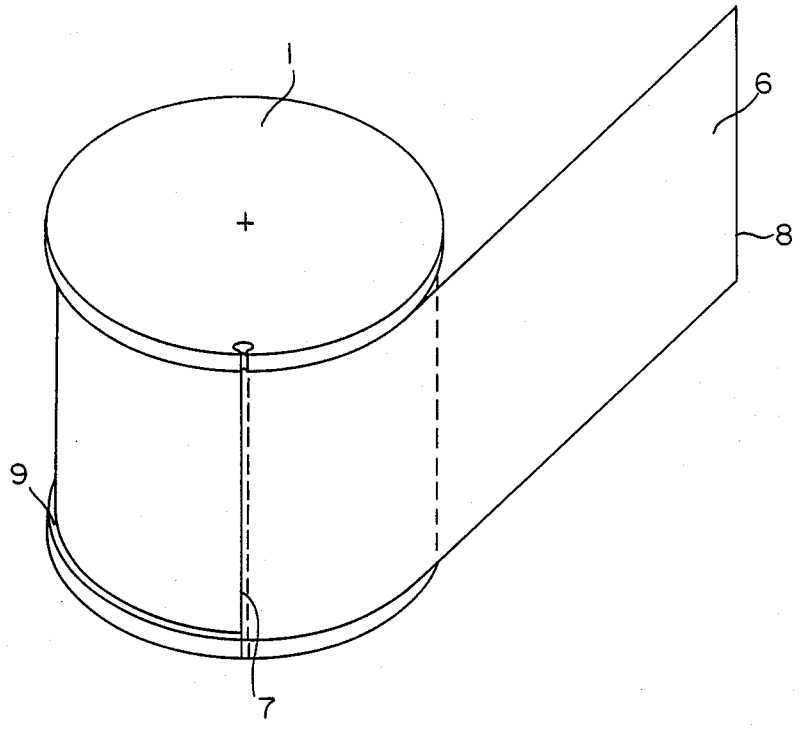
FIG. 2 illustrates schematically the band during unwinding from the outer peripheral surface of the submunition unit.
Figure 3:
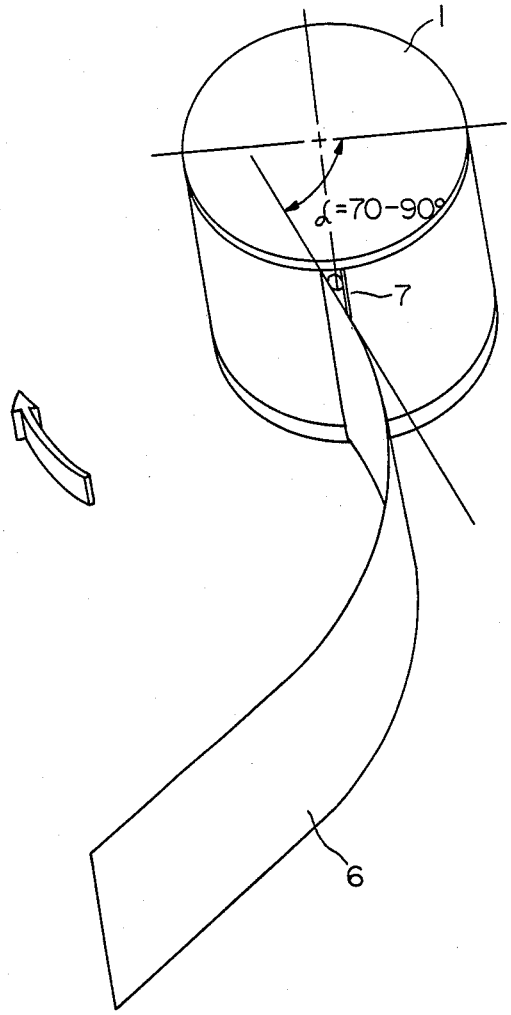
FIG. 3 illustrates the band in its outswung position just before being released forming an outswung angle $\alpha=70°-90°$.

FIG. 2 illustrates the system submunition unit with its body in the form of a band 6 arranged to be swung outwardly. The band 6 could be wrapped one or more loops around the peripheral surface of the submunition unit. The free end 8 of the band starts unwinding as soon as the submunition unit has been separated from the carrier shell. The other end 7 of the band is fixed to the submunition unit 1 so that the band 6 is released in an outswung position (FIG. 3). When the band is unwound the moment of inertia and the center of rotation of the system are changed. The rotational speed of the band and submunition unit is reduced. When the band has been released from the submunition body the submunition continues its own movement in the tangential direction, i.e. its direction in the rotating system at the moment of separation. The tangential speed of the submunition unit in the rotating system becomes the lateral speed after separation. The number of revolutions and the lateral speed of the submunition unit after separation depends on the original rotational speed and ratio of masses of the band and the submunition unit.

With a suitable mass proportion between the submunitions unit and the band, which do not make the stresses in the band itself and its fastening point too high, a lateral speed of approximately 10 m/s can be obtained if the rotational speed of the band prior to separation amounts to 10,000 rpm. The separation phase itself takes approximately 10 ms. The rotational speed of the submunition unit in this case has decreased to approximately 1000 rpm.

As illustrated in FIG. 2, in this case the width of the band is approximately the same as the width of the submunition unit. Preferably the band is located in a recess 9 in the outer peripheral surface. The band is made of a high steel quality with an appropriate thickness.

If the center of gravity of the band and of the submunition unit coincide (FIG. 4) in the direction of the rotational axis before separation the submunition unit will rotate about the same axis after separation. If the centers of gravity do not coincide (FIG. 4*a*), the submunition unit will rotate about another axis after separation. Then the submunition unit becomes a tumbling movement, the frequency of which can be controlled by means of the relative positions of the centers of gravity 20 and 21 for the band and the submunition unit respectively. The center of gravity of the band relative to the submunition unit can easily be changed by making the band smaller and changing its position in the direction of the symmetrical axis or making the mass distribution of the band non homogenic in the direction of the symmetrical axis.

Figure 5:
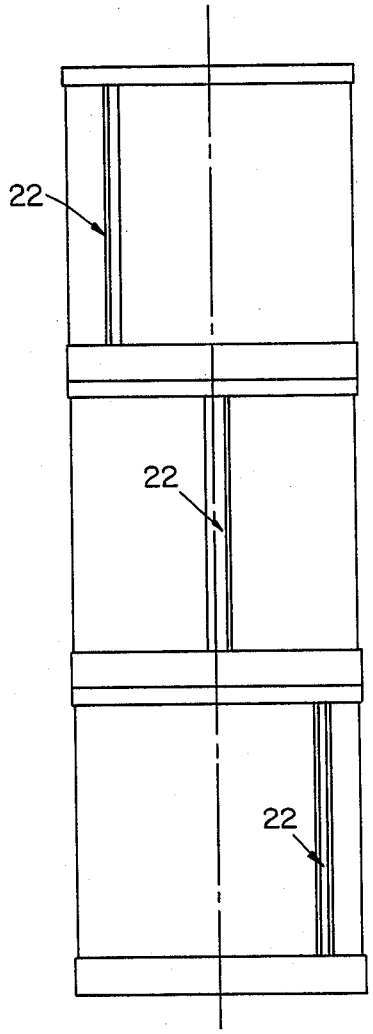
FIG. 5 illustrates three ammunition units with respective bands fastened in different circular positions.

By arranging the fastening point of the bands in different angular positions 22 in the canister each submunition unit obtains its own lateral direction (FIG. 5).

Even if the body which is arranged to the swung out preferably is made in the form of a band as illustrated also other forms can be used.

Even if the invention now has been described substantially in connection with a submunition unit it should be understood that the invention is not limited to that type of ammunition unit but can be used also for other types of such units in which a lateral movement is desired at the same time as a reduction of the rotational speed is obtained.

We claim:

1. In combination with an ammunition unit a device for reducing the rotational speed of said ammunition unit, and at the same time imparting a lateral speed to said unit, said ammunition unit including a substantially cylindrical outer surface, said device comprising a single band wrapped around the outer peripheral surface of said unit, said band being asymmetrically attached at one end to said unit such as to swing outwardly and be released from the surface of said unit when said band forms a predetermined outswung angle with respect to said ammunition unit, whereby imparting lateral speed to the ammunition unit.

2. A device according to claim 1, wherein said outswung angle is in a range of 70°-90°.

3. A device according to claim 1, wherein the center of gravity of the ammunition unit and of the band coincide in the direction of the rotational axis before separation, such that a stable, decreased rotation about the same rotational axis is imparted to the ammunition unit after separation.

4. A device according to claim 1, wherein the center of gravity of the ammunition unit and of the band are displaced with respect to each other in the direction of the rotational axis before separation in order to provide the ammunition unit with a rotation about another axis.

5. A device according to claim 1, wherein when discharging a number of ammunition unit, said units are spread in different lateral directions by means of different angular positions of the fastening points of the different bands.

* * * * *